US006811433B2

(12) United States Patent
Jou

(10) Patent No.: US 6,811,433 B2
(45) Date of Patent: Nov. 2, 2004

(54) ELECTRICAL CONNECTOR

(75) Inventor: Jing Jou, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/650,175

(22) Filed: Aug. 28, 2003

(65) Prior Publication Data

US 2004/0115969 A1 Jun. 17, 2004

(30) Foreign Application Priority Data

Aug. 30, 2002 (TW) ..... 91213679 U

(51) Int. Cl.[7] ..... H01R 13/60
(52) U.S. Cl. ..... 439/541.5; 439/79
(58) Field of Search ..... 439/541.5, 540.1, 439/79, 942

(56) References Cited

U.S. PATENT DOCUMENTS 4,818,239 A * 4/1989 Erk ..... 439/55
4,857,017 A * 8/1989 Erk ..... 439/79
5,037,330 A * 8/1991 Fulponi et al. ..... 439/541.5
5,080,596 A * 1/1992 Viselli et al. ..... 439/79
5,336,109 A * 8/1994 Hillbish et al. ..... 439/541.5
6,126,481 A * 10/2000 Wu et al. ..... 439/541.5
6,200,161 B1 * 3/2001 McClinton et al. ..... 439/541.5
6,250,957 B1 * 6/2001 Chang ..... 439/541.5
6,663,423 B2 * 12/2003 Belopolsky et al. ..... 439/541.5

* cited by examiner

*Primary Examiner*—Tho D. Ta
(74) *Attorney, Agent, or Firm*—Robert J. Zeitler

(57) ABSTRACT

An electrical connector includes an insulative housing, a first conductive terminal module, a second conductive terminal module, and two positioning parts. The insulative housing has a body having an upper insertion part and a lower insertion part. The body has a first face and a second face opposite to the first face. The insertion parts extend from the first face in a direction away from the second face. The insertion part on the lower half of the body include a first set of conductive terminals and the insertion part on the upper half includes a second set of conductive terminals, each conductive terminal having a first contact and a second contact, the first contacts extending from the first face of the body in a direction away from the second face and the second contacts protrude from the second face in a direction away from the first face. The body has a plurality of first projections respectively at a lower position on the second face, the first projections respectively dividing and positioning the second contacts of the first set of conductive terminals individually. In addition the connector is designed by a stacked type and will not increase the area of the electrical circuit board.

12 Claims, 13 Drawing Sheets

RELATED ART

RELATED ART

ELECTRICAL CONNECTOR

FIELD OF THE INVENTION

The present invention relates to an electrical connector, and particularly to the connector installed on an electrical circuit board, which can be used to transfer the electrical information during the connection with at least two mating connectors.

DESCRIPTION OF RELATED ART

Referring to the FIG. 1, FIG. 2, and FIG. 3, it is from the patent of application Ser. No. 90212621 (R.O.C. publication no. 493804), and with the name "connector II", in which the connector 1 can be used to be connected with a matching coupled electrical connector (is not shown in the Figure), from the connection the electrical information can be transferred. The electrical connector 1 mainly includes an insulative housing 10, a conductive terminal module 2, and two plate lockers 15.

The insulative housing 10 is formed by a long rectangular body 11 having two ends, an insertion part 12 connecting the body 11, an insertion guiding part 13, a supporting part 16, and in addition further two connection parts 14.

The body 11 has a first face 111 for connecting a coupled electrical connector; a second face 112 opposite to the first face 111; a first end 113 extending from an end of the longitudinal body 11, a second end 114 extending on an opposite end thereof relative to the first end 113; a first dependent plate 115; a second dependent plate 116, both the first dependent 115 and the second dependent plate 116 are face to each other and together defined by the first face 111, the second face 112, the first end 113 and the second end 114; and a plurality of terminal through holes 117 arranged on the body 11 for penetrating from the first face 111 to the second face 112. For assembly, either the first dependent plate 115 or the second dependent plate 116 could be installed towards a circuit board 3.

The insertion part 12 is connected to the first face 111 and extends outwardly from the first face 111. The insertion part 12 has a connection plane 121 and a back plane 122, the connection plane 121 has a plurality of terminal receiving grooves 1211, respectively, corresponding to the terminal through holes 117, and in addition the connection plane 121 provides an idiot-proofing block 1212 preventing from error install. The back plane 122 has a holding recess 1221.

The insertion guiding part 13, also, is connected to the first face 111 and extends outwardly from the first face 111. The insertion guiding part 13 and the insertion part 12 together define a gap therebetween. The insertion guiding part 13 has a guiding recess 131 at a side thereof adjacent to the insertion part 12. In similar way the supporting part 16 is formed on the first face 111 adjacent to the second end 114, and extends outwardly from the first face 111. The supporting part 16 and the insertion guiding part 13 are symmetrically arranged on the body 11.

Besides, the two connection parts 14 are connected to the second face 112 and adjacent to, respectively, the first end 113 and the second end 114 of the body 11, the two connection parts 14 extend outwardly from the second face 112. The connection parts 14 each has a bottom plate 142 for contacting to the circuit board 3, a top plate 141 opposite to the bottom plate 142, and a connecting hole 143 relative to a fixing hole 32 arranged on the circuit board 3 for penetrating thereof from the top plate 141 to the bottom plate 142.

The conductive terminal module 2 has a plurality of conductive terminals 21 abreast, the conductive terminals 21 each has a plurality of first contacts 211 fixedly contained in each the terminal receiving grooves 1211, and a plurality of second contacts 212 outwardly protruded on the second face 112 between the two connection parts 14 for respectively penetrating through the terminal through holes 117.

The plate lockers 15 each has a stopping strip 151, and a fastening buckle 152 corresponding to the stopping strip 151. The fastening buckle 152 has two flexibly deformable hooks 1521 at an end thereof for projecting outwardly in two directions opposite to each other. While the fastening buckle 152 penetrates from the top plate 141 through the connecting hole 143 into the fixing hole 32, the hooks 1521 each hooks an opposite rim of the fixing hole 32, and the stopping strip 151 retains in the connecting hole 143.

For assembly with the circuit board 3, the circuit board 3 has a rectangular recess matching the electrical connector 1 at an edge thereof, a plurality of soldering pins 31 respectively corresponding to the conductive terminals 21, and the two fixing holes 32 each corresponding to the connecting hole 143 for the bottom plate 141 of the two connection parts 14 of the insulative housing 10 electrically connection with an surface of the circuit board 3 at the same time. The second contact 212 is correspondingly soldered to each the soldering pins 31 by surface mounted technology for electrical connection. While the fastening buckle 152 penetrates through the connecting hole 143 to connect with the fixing hole 32 of the circuit board 3 by the hooks 1521.

After that, the guiding recess 131 and the holding recess 1221 guide and position the matching the mating connector to the insertion part 12, furthermore the mating connector transfers electrical information by contacting with the first contact 211 for connection to the circuit board 3.

Whereby the two plate lockers 15 restrict a relative position between the insulative housing 10 and the circuit board 3, the plate lockers 15 will bear lots of resistance to share the loading of the conductive terminals 21 in the condition of inserting connection of the mating connector or the condition of compact of the lateral force after the insertion of the mating connector. On the presupposition of the electrical connector standardization, position-matching abilities of the insulative housing 10 and the circuit board 3 can be improved to prevent the failure of the electrical connector 1 from the destruction of the conductive terminals 21.

Although the electrical connector 1 can provide advantages mentioned above by the two plate lockers 15 restricting a relative position between the insulative housing 10 and the circuit board 3. The electrical connector 1 just provides only one inserting connection with the circuit board 3 for just only one mating connector, and fails to meet the requirement by addition of mating connectors. It needs therefore to add a plurality of fixing holes at a predetermined position on the circuit board 3, respectively corresponding to a plurality of electrical connectors 1, which are arranged in a similar way at the edge of the same surface in sequence or are staggered up and down at the edge of two opposite surfaces, for respectively insertion with a plurality of mating connectors. But above action will correspondingly lead to increasing area of the circuit board 3 resulting in increasing volume of electrical equipment, and will not achieve the goal of small size with means light.

Therefore, the above-mentioned prior art electrical connector, obviously, has inconvenience and disadvantages in practice, and the improvement is required.

SUMMARY OF THE INVENTION

The object of the present invention is to provide an electrical connector including a plurality of insertion parts for inserting connection with a plurality of mating connectors and electrical connection with a circuit board, and in a stacked type without increasing area of the circuit board and volume of the electrical equipment to achieve the goal of the small size with means light.

In order to achieve the object set forth, an electrical connector, which electrically connects to a circuit board and provides inserting connection with two mating connectors, has an insulative housing forming a body and two insertion parts respectively connected to an upper half and a lower half of the body. The body has a first face and a second face opposite to the first face. The insertion parts extend from the first face in a direction away from the second face. The insertion part on the lower half of the body include a first set of conductive terminals and the insertion part on the upper half includes a second set of conductive terminals, each conductive terminal having a first contact and a second contact, the first contacts extending from the first face of the body in a direction away from the second face and the second contacts protrude from the second face in a direction away from the first face. The body has a plurality of first projections respectively at a lower position on the second face, the first projections respectively dividing and positioning the second contacts of the first set of conductive terminals individually.

Additionally, the first projections may position the second contacts of the second set of conductive terminals individually.

In a further embodiment, the body has a plurality of second projections respectively at an upper position on the second face, so that the second projections respectively divides and positions the second contacts of the second set of conductive terminals individually.

In yet another embodiment, the second contacts of the first conductive terminals are alternatively arranged with the second contacts of the second conductive terminals in a single row.

In still another embodiment, the second contacts of the second conductive terminals are divided into two groups, and the second contacts of the first conductive terminals are arranged between the two groups of the second contacts of the second set of conductive terminals.

The invention of the present application may also include the second contacts of the first conductive terminals arranged separate from the second contacts of the second conductive terminals in two rows.

The invention may also include the second contacts of the first conductive terminals and the second contacts of the second conductive terminals alternatively arranged with each other.

In a further embodiment, the electrical connector includes an insertion guiding part extending from the first face in a direction away from the second face, the guiding part including guiding recesses corresponding to the upper and lower insertion parts.

In another embodiment, the insertion guiding part prevents the improper mating of the mating connectors with the electrical connector assembly.

Other objects and embodiments of the present invention are further detailed in the detailed description of the present invention that follows.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
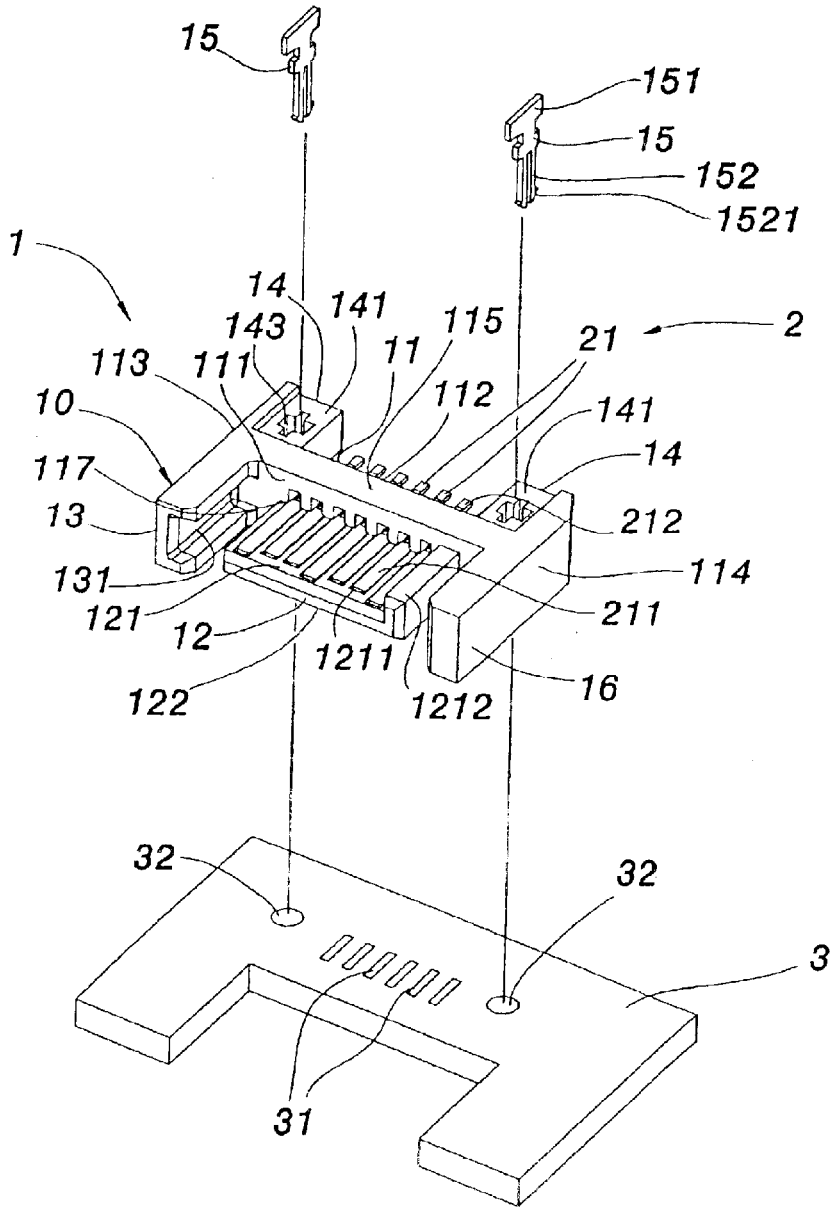
FIG. 1 is an exploded view of prior art electrical connector and a circuit board.
Figure 2:
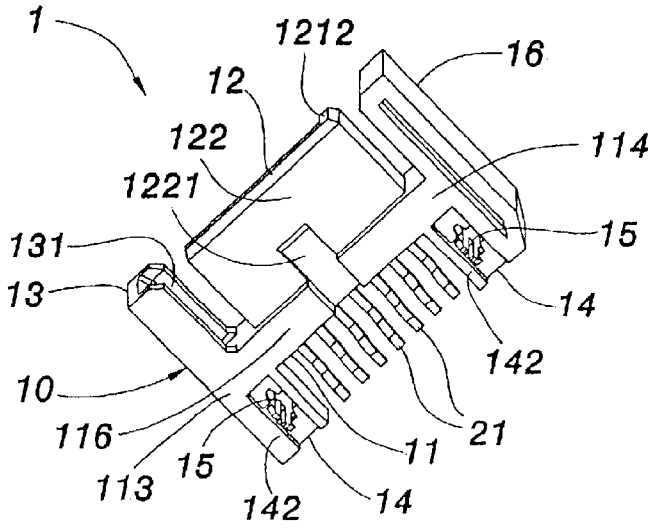
FIG. 2 is a perspective view of prior art electrical connector.
Figure 3:
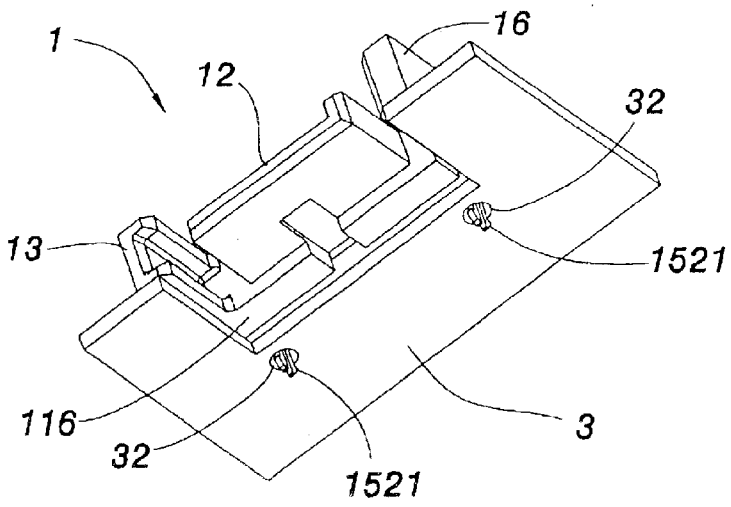
RELATED ART FIG. 3
FIG. 3 is a perspective of prior art electrical connector and a circuit board.
Figure 4:
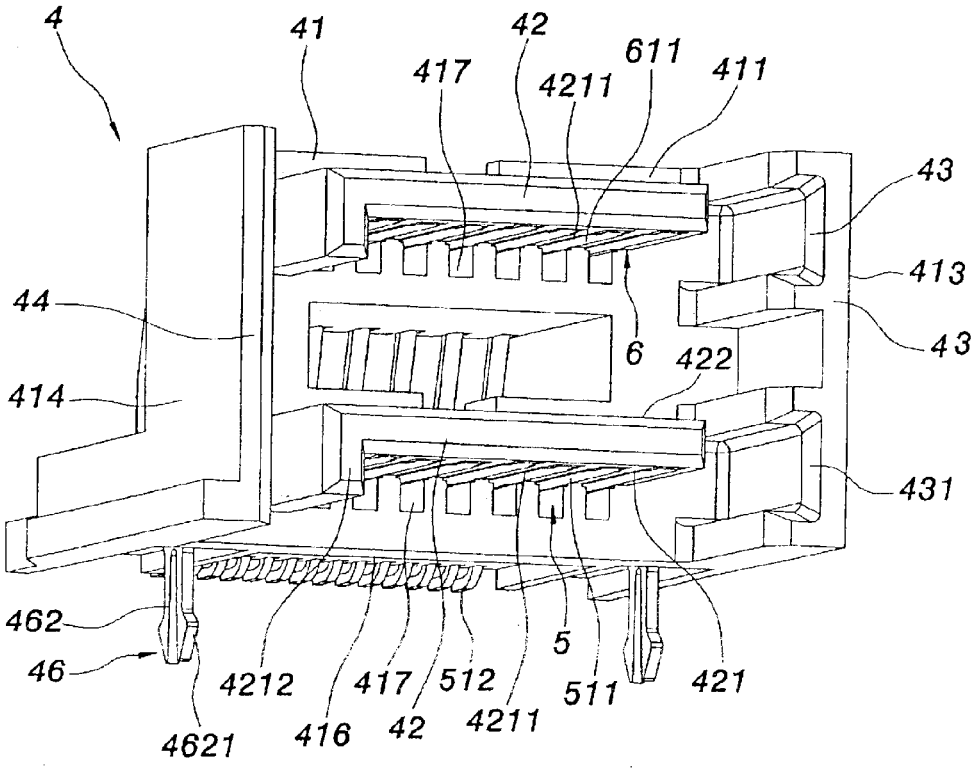
FIG. 4 is a perspective view according to the first embodiment of an electrical connector of the present invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Referring to the FIG. 4 to FIG. 8, one preferred embodiment of the present invention provides an electrical connector comprising an insulative housing 4, a first conductive terminal module 5, a second conductive terminal module 6, and two positioning parts 46. The insulative housing 4 is made of plastic material, and has a body 41, two insertion parts 42 connected to an upper half and a lower half of the body 41, an insertion guiding part 43, a supporting part 44, and at least one connection part 45 that is preferred to be two connection parts 45 in the present embodiment.

The body 41 has a first face 411 for connecting a mating connector; a second face 412 opposite to the first face 411;

a first end 413 extended from an end of the longitudinal body 41, a second end 414 extended form an opposite end relative to the first end 413; a first dependent plate 415, a second dependent plate 416, wherein the first dependent plate 415 and the second dependent plate 416 both are face to each other and together defined by the first face 411, the second face 412, the first end 413 and the second end 414. For assembly, the second dependent plate 416 can just be installed towards a circuit board. The body 41 has a plurality of terminal through holes 417 respectively arranged in two rows on the upper half and a lower half on the body 11 for penetrating from the first face 411 to the second face 412.

The two insertion parts 42 are connected to the first face 411 and extend outwardly from the first face 411. The insertion parts 42 each has a connection plane 421 and a back plane 422, the connection plane 421 has a plurality of terminal receiving grooves 4211, respectively, corresponding to the terminal through holes 417, and in addition the connection plane 421 provides a block 4212 so as to prevent the improper mating of a mating connector with the electrical connector. The back plane 422 has a holding recess 4221.

The insertion guiding part 43, also, is connected to the first face 411 and extends outwardly from the first face 411. The insertion guiding part 43 and each the insertion part 42 together define a gap therebetween. The insertion guiding part 43 has a guiding recess 431 at a side thereof adjacent to each the insertion parts 42. In similar way the supporting part 44 is formed on the first face 411 adjacent to the second end 414, and extends outwardly from the first face 411. The supporting part 44 and the insertion guiding part 43 are symmetrically arranged on the body 41.

Besides, the connection parts 45 are connected to the second face 412 and adjacent to, respectively, the first end 413 and the second end 414 of the body 41, and the connection parts 45 extend outwardly from the second face 412. The connection parts 45 each has a bottom plate (not shown) for contacting to the circuit board, a top plate 451 opposite to the bottom plate, and a connecting hole 452 corresponding to a fixing hole arranged on the circuit board for penetrating thereof from the top plate 451 to the bottom plate.

The first conductive terminal module 5 has a plurality of first conductive terminals 51 abreast, the first conductive terminals 51 each has a plurality of first contacts 511 respectively fixedly contained in the terminal receiving grooves 4211 of the lower insertion part, and a plurality of second contacts 512 outwardly protruded on the second face 412 between the two connection parts 45 for respectively penetrating through the terminal through holes 417.

The second conductive terminal module 6 has a plurality of second conductive terminals 61 abreast, the second conductive terminals 61 each has a plurality of first contacts 611 respectively fixedly contained in the terminal receiving grooves 4211 of the upper insertion part 42, and a plurality of second contacts 612 outwardly protruded on the second face 412 between the two connection parts 45 for respectively penetrating through the terminal through holes 417. Each of the second contacts 512 of the first conductive terminals 51 of the first conductive terminal module 5 are alternatively one after another arranged with each of the second contacts 612 of the second conductive terminals 61 of the second conductive terminal module 6 in a single row.

Figure 9:
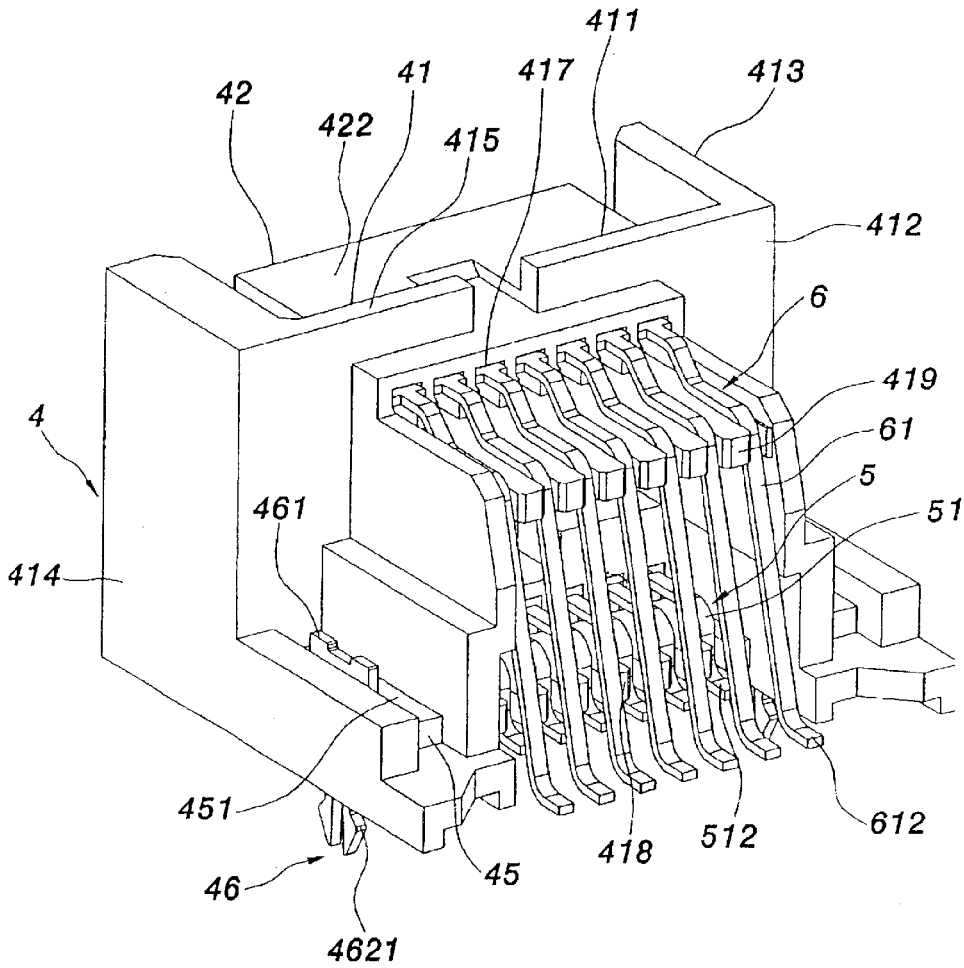
FIG. 9 is a perspective view according to the second embodiment of the electrical connector of the present invention.

In another embodiment the second contacts 512 of the first conductive terminals 51 of the first conductive terminal module 5 are arranged separate from the second contacts 612 of the second conductive terminals 61 of the second conductive terminal module 6 alternatively staggered with each other or in a one-on-one relationship in two rows (shown as the FIG. 9).

Figure 13:
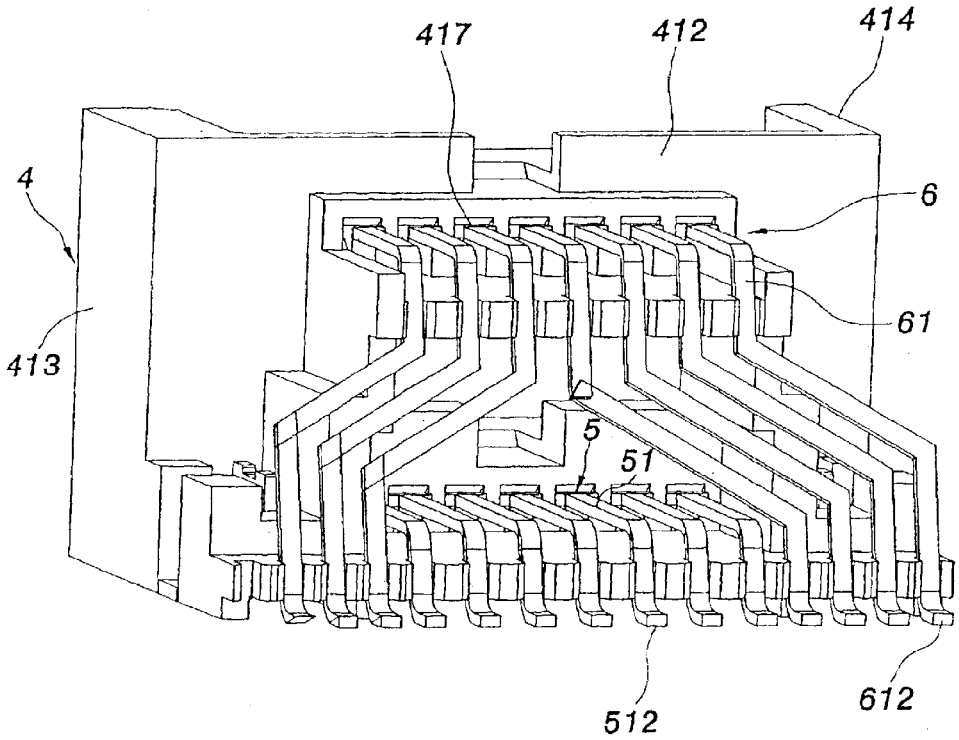
FIG. 13 is a perspective view according to the sixth embodiment of the electrical connector of the present invention.
Figure 14:
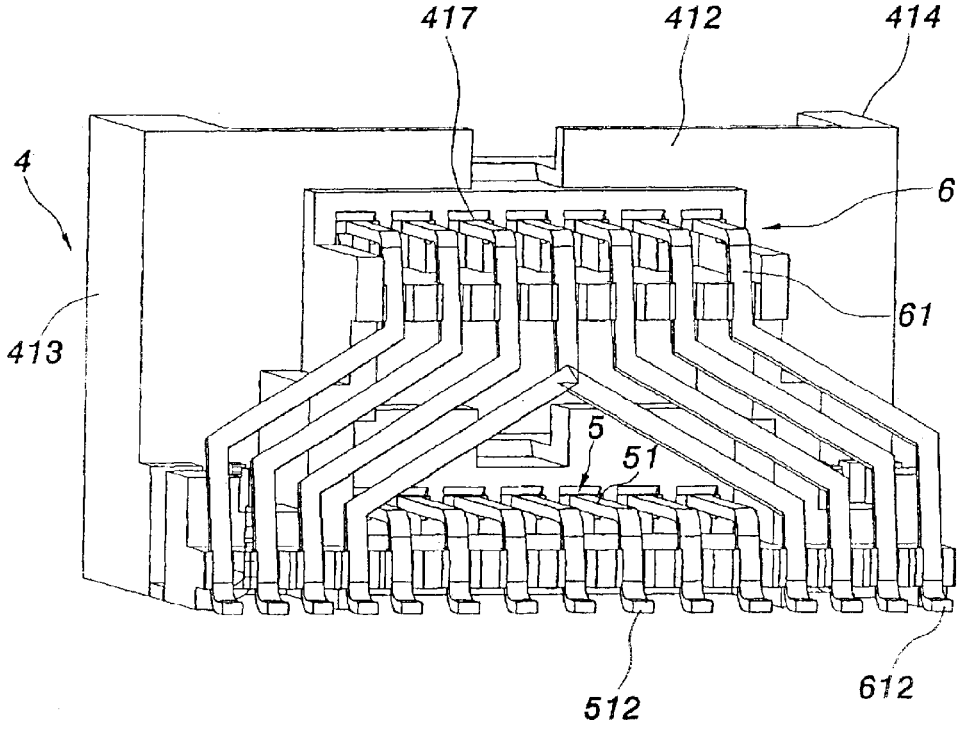
FIG. 14 is a perspective view according to the seventh embodiment of the electrical connector of the present invention.

In third embodiment the second contacts 512 of the first conductive terminals 51 of the first conductive terminal module 5 and the second contacts 612 of the second conductive terminals 61 of the second conductive terminal module 6 could be arranged in a single row, wherein the second contacts 612 of the second conductive terminals 61 of the second conductive terminal module 6 are divided into two groups and respectively arranged at two ends of the single row, and the second contacts 512 of the first conductive terminals 51 of the first conductive terminal module 5 could be arranged therebetween in the middle of the single row (shown as the FIG. 13 and FIG. 14).

Figure 5:
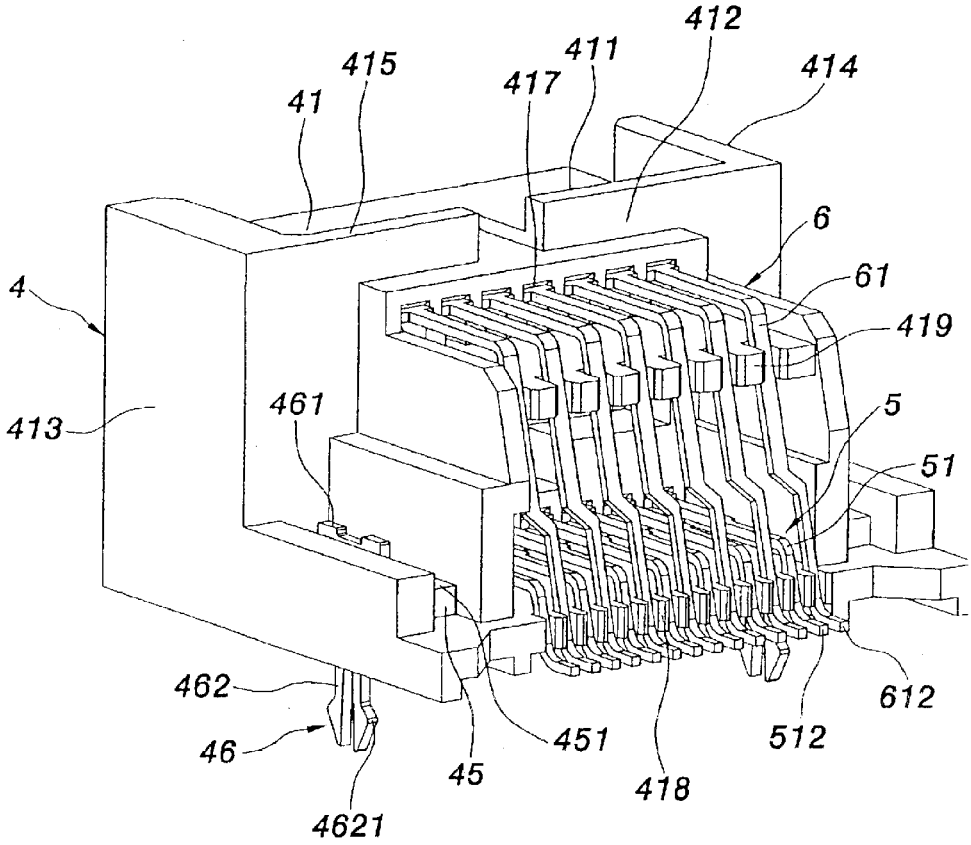
FIG. 5 is another point of perspective view according to the first embodiment of the electrical connector of the present invention.
Figure 6:
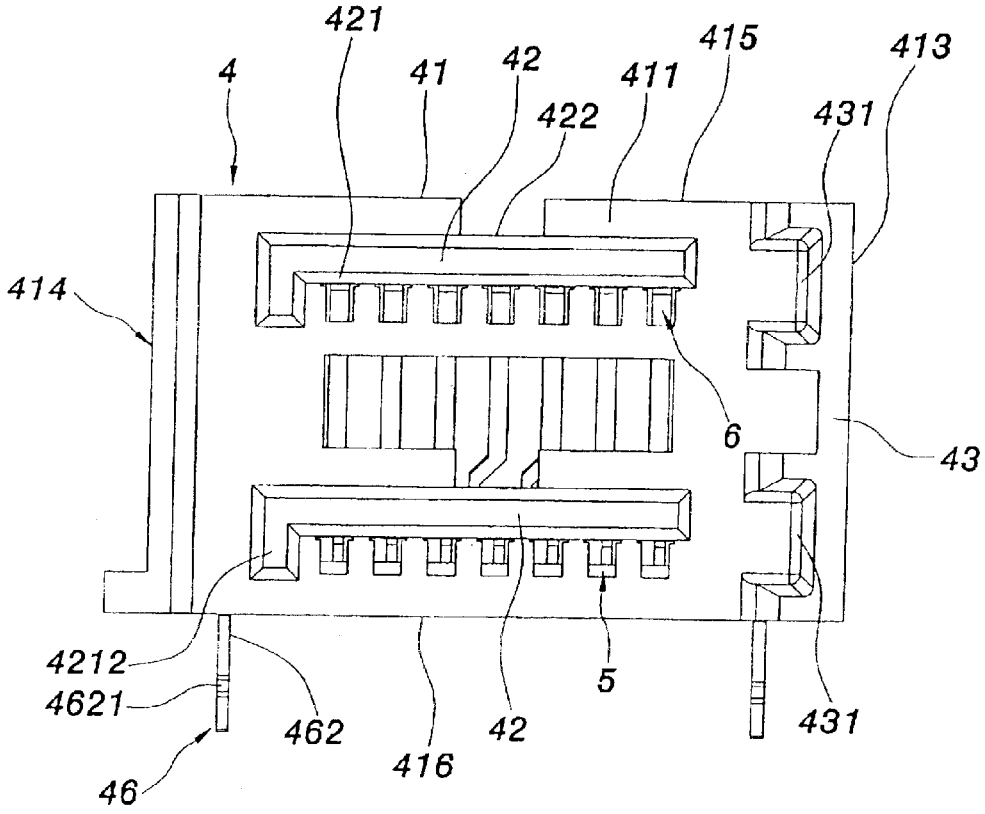
FIG. 6 is a front elevational view according to the first embodiment of the electrical connector of the present invention.
Figure 7:
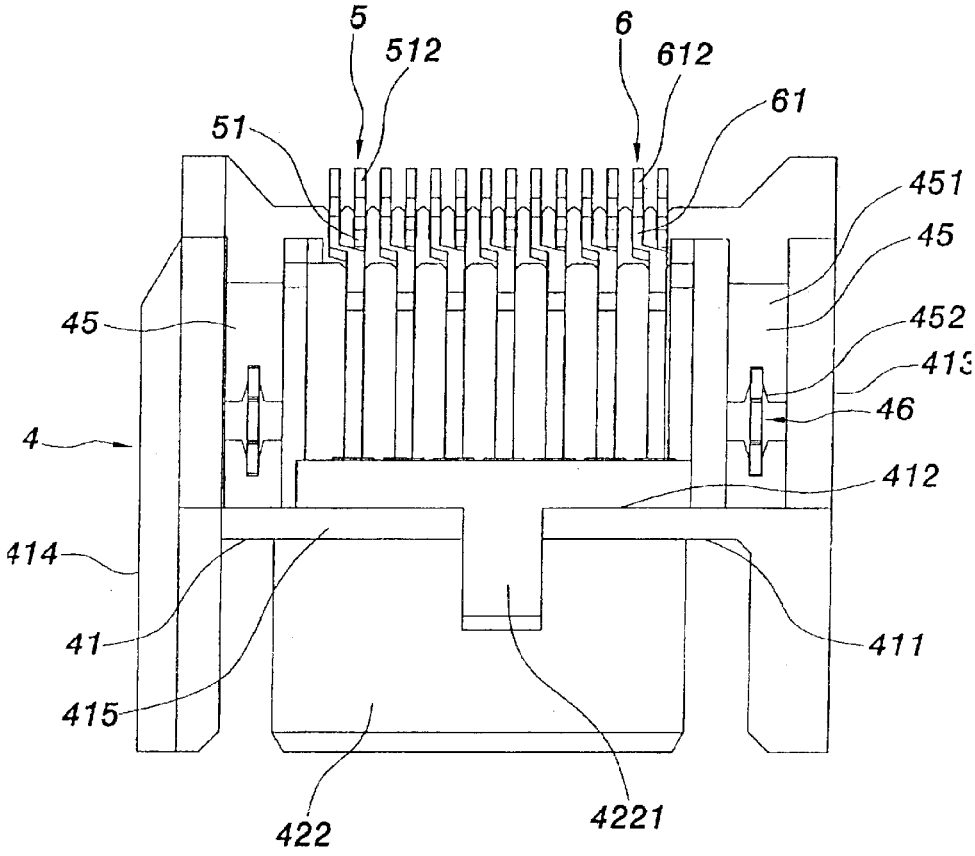
FIG. 7 is top plan view according to the first embodiment of the electrical connector of the present invention.
Figure 8:
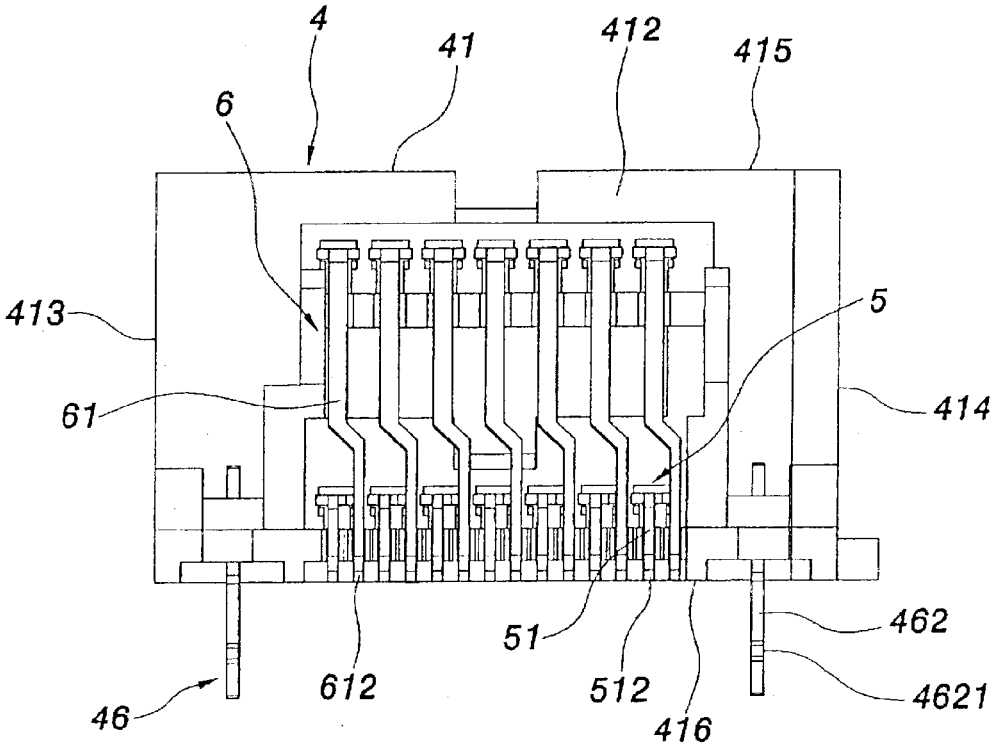
FIG. 8 is a back elevational view according to the first embodiment of the electrical connector of the present invention.

The body 41 has a plurality of first projections 418 respectively at a lower position on the second face 412, and the first projections 418 respectively divides and positions the first conductive terminals 51 of the first conductive terminal module 5 and the second conductive terminals 61 of the second conductive terminal module 6 individually (shown as the FIG. 5). In another embodiment the first projections 418 each could be just used to divide and position only the first conductive terminals 51 of the first conductive terminal module 5 individually (shown as the FIG. 9), and the body 41 further includes a plurality of second projections 419 respectively at an upper position on the second face 412 and the second projections 419 each for division and position the second conductive terminals 61 of the second conductive terminal module 6 individually.

The positioning parts 46 each, defining a plate-locking part in the present embodiment, includes a stopping strip 461, and a fastening buckle 462 corresponding to the stopping strip 461. The fastening buckle 462 has two flexibly deformable hooks 4621 at an end thereof for projecting outwardly in two directions opposite to each other. While the fastening buckle 462 penetrates from the top plate 451 through the connecting hole 452 into the fixing hole of the circuit board, the hooks 4621 each hooks an opposite rim of the fixing hole.

For assembly with the circuit board (not shown), the circuit board has a plurality of soldering pins respectively corresponding to the first conductive terminals 51 and the second conductive terminals 61, and a plurality of fixing holes (not shown) each corresponding to the connecting hole 452 of the connection part 45 for each the bottom plates of the two connection parts 45 of the insulative housing 40 electrically connection with an surface of the circuit board at the same time. The second contacts 512 of the first conductive terminals 51 and the second contacts 612 of the second conductive terminals 61 are respectively correspondingly soldered to the soldering pins 31 by surface mounted technology for electrical connection. While the fastening buckle 452 penetrates through each the connecting holes 452 to connect with each the fixing holes of the circuit board by the hooks 4621. In another embodiment the positioning parts 46 are also a type of surface mounted devices (shown as the FIG. 13 and the FIG. 14) to mount on the circuit board by the surface mounted technology.

After that, the guiding recess 431 and the holding recess 4221 guide and position the matching mating connector to the insertion part 42, furthermore a plurality of mating connectors transfer electrical information for contact respectively with the first contacts 511 of the first conductive terminals 51 and the first contacts 611 of the second conductive terminals to connect the circuit board.

Whereby the two positioning parts 46 restrict a relative position between the insulative housing 40 and the circuit board, the positioning parts 46 will bear lots of resistance to share the loading of the first conductive terminals 51 and second conductive terminals 61, in the condition of inserting connection of the mating connectors or the condition of compact of the lateral force after the insertion of the mating connector. On the presupposition of the electrical connector standardization, position-matching abilities of the insulative housing 40 and the circuit board can be improved to prevent the failure of the electrical connector 1 from the destruction of the first conductive terminals 51 and second conductive terminals 61. In another embodiment the positioning parts 46 could be replaced to be the positioning poles or other positioning means, or each the positioning parts 46 could be formed with each the connection parts 45 integrally in one piece.

Figure 10:
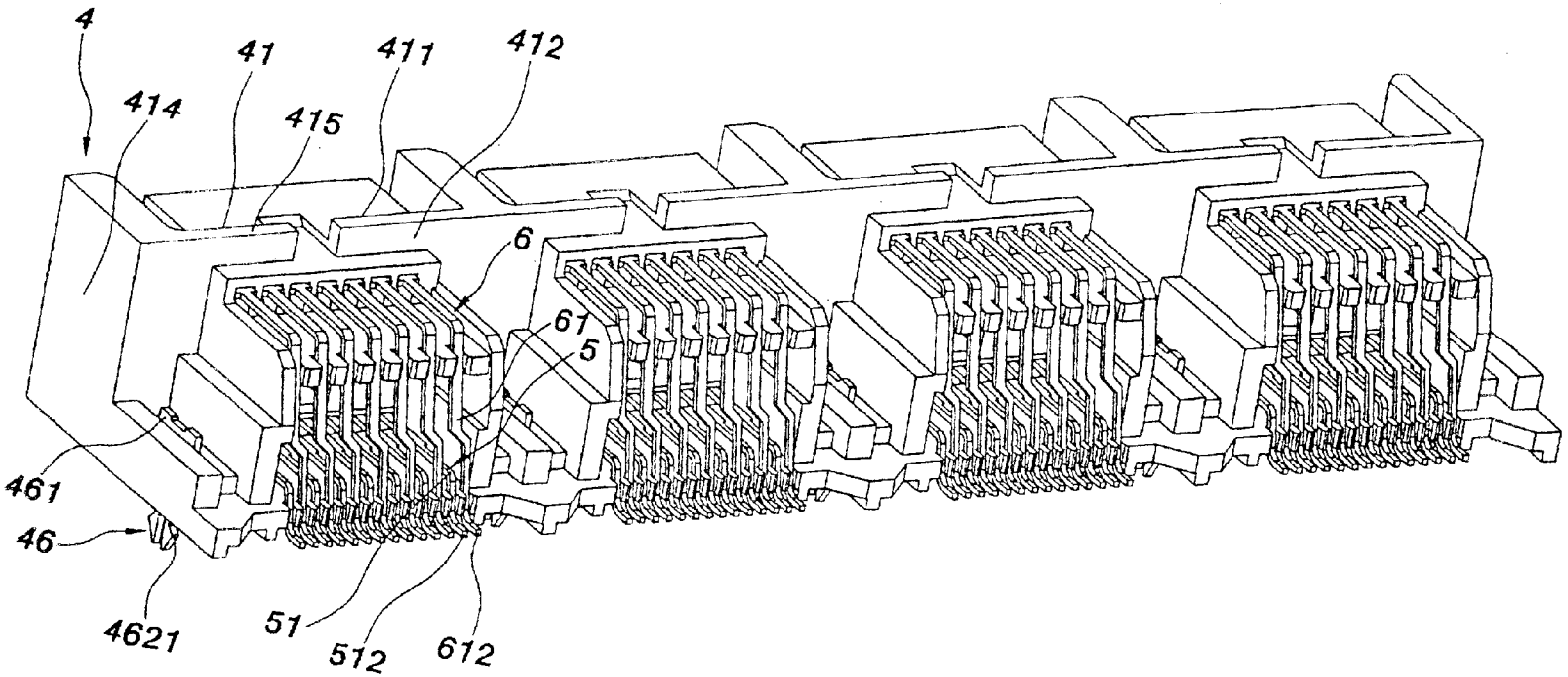
FIG. 10 is a perspective view according to the first embodiment of a complex connector combined with the electrical connectors by the third embodiment of the present invention.
Figure 11:
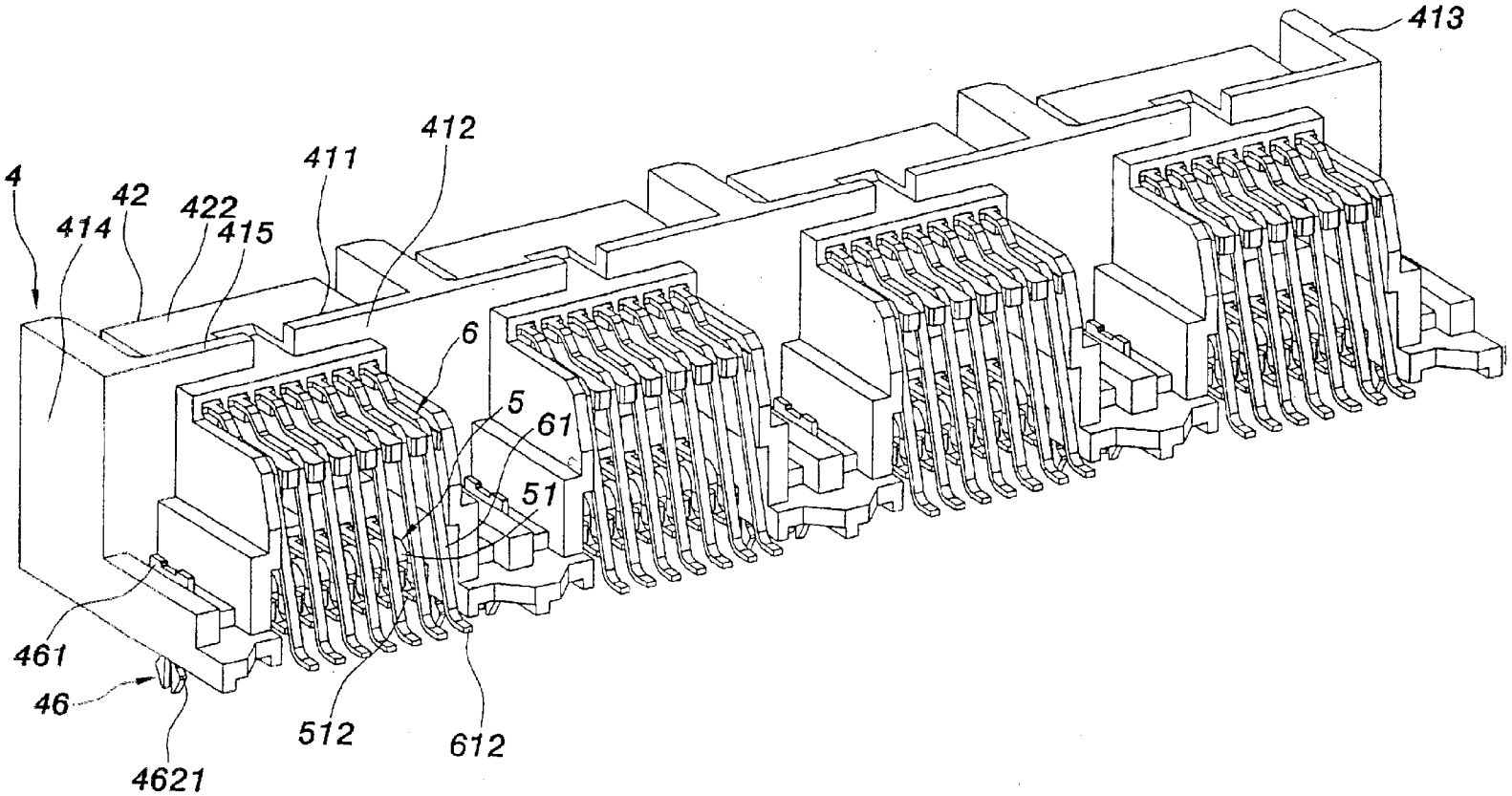
FIG. 11 is a perspective view according to the second embodiment of a complex connector combined with the electrical connectors by the fourth embodiment of the present invention.

Furthermore, the single electrical connector mentioned above seems to be a combination, two or more than two electrical connectors could be a complex connector for inserting connection with four or more than four mating connectors. Referring to the FIG. 9 and FIG. 10, it's one embodiment providing a complex connector combined with each of four electrical connectors by a way that the first end 413 of one single body 41 of one of the connectors connects to the second end 414 of the body 41 of another of the connecters that is adjacent to the one, wherein the one and the another are combined with each other or integrally formed in one piece. The complex connector has the connection parts 45 at the two ends thereof, and between the first conductive terminal module 5 and the second conductive terminal module 6. Another embodiment of the positioning parts 46 of the complex connector is in similar way to the single electrical connector, and the arrangement of the positioning parts 46 is no more to be described.

Figure 12:
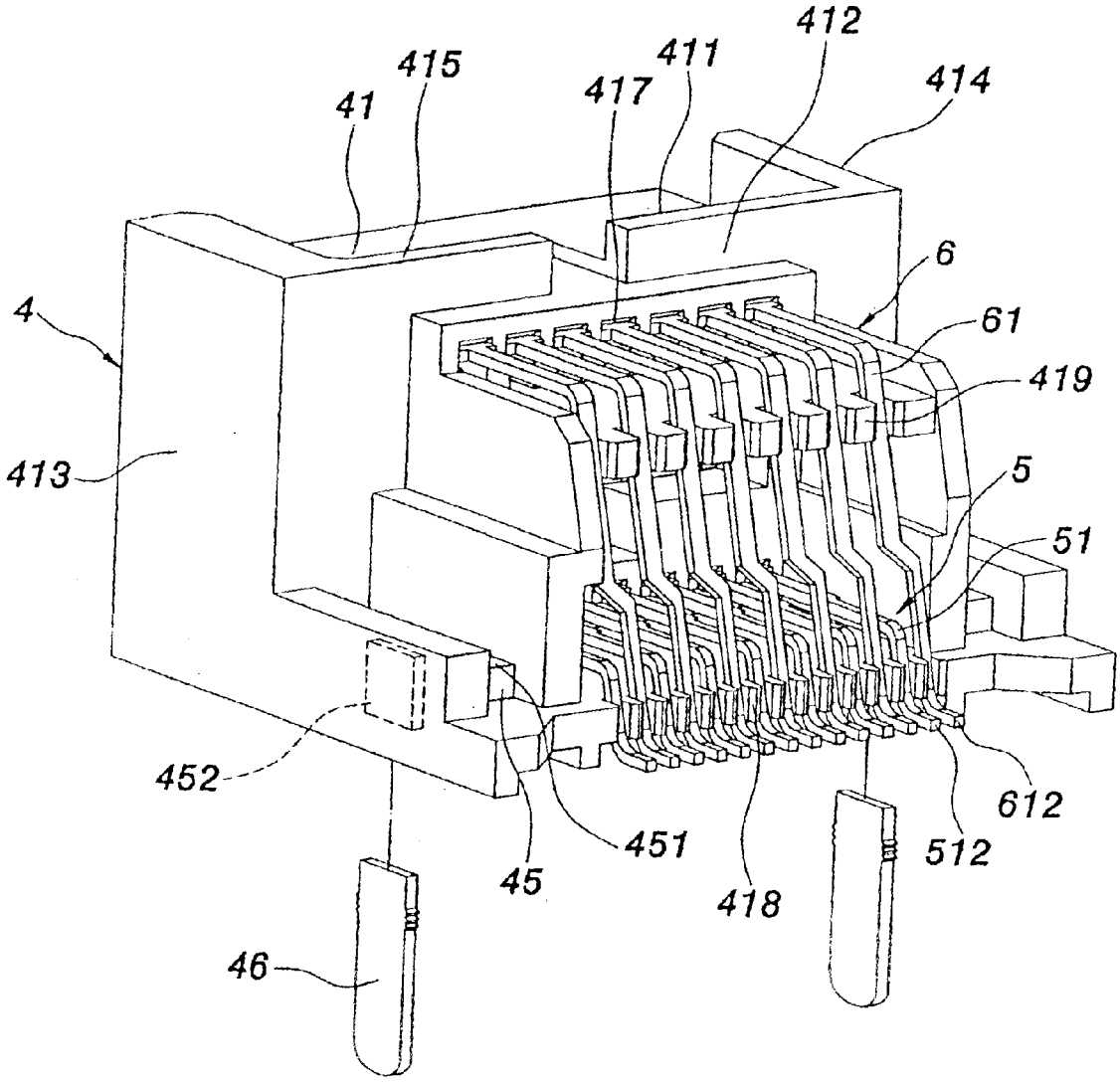
FIG. 12 is a perspective view according to the fifth embodiment of the electrical connector of the present invention.

In another embodiment the connecting hole 452 could be a recess formed up straight from the bottom plate and not penetrate through the top plate 451, the configuration of the positioning part 46 could be various for providing an inserting connection with the connecting hole 452 of the connection part 45 (shown as the FIG. 12).

The present invention provides a plurality of mating connectors for providing an inserting connections with the circuit board for electrical connection, and provides a electrical connector designed by a stacked type to maintain the area of the circuit board and the volume of the electrical equipment to achieve the goal of small size with means light.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An electrical connector for mounting on a circuit board for providing an inserting connection with two mating connectors, comprising:

an insulative housing having a body formed thereto, two insertion parts respectively located on an upper half and a lower half of the body;

the body having a first face and a second face opposite to the first face, the insertion parts extending from the first face in a direction away from the second face;

wherein the insertion part on the lower half of the body include a first set of conductive terminals and the insertion part on the upper half includes a second set of conductive terminals, each of the first set of conductive terminals and the second set of conductive terminals having a first contact and a second contact, the first contacts extending from the first face of the body in a direction away from the second face and the second contacts protrude from the second face in a direction away from the first face;

wherein the body has a plurality of first projections respectively at a lower position on the second face, the first projections respectively dividing and positioning the second contacts of the first set of conductive terminals individually; and wherein the second contacts of the first set off conductive terminals are alternatively arranged with the second contacts of the second set off conductive terminals in a single row.

2. The electrical connector of claim 1, wherein the first projections position the second contacts of the second set of conductive terminals individually.

3. The electrical connector of claim 1, wherein the body has a plurality of second projections respectively at an upper position on the second face, so that the second projections respectively divides and positions the second contacts of the second set of conductive terminals individually.

4. The electrical connector of claim 1, wherein the second contacts of the second conductive terminals are divided into two groups, and the second contacts of the first conductive terminals are arranged between the two groups of the second contacts of the second set of conductive terminals.

5. The electrical connector of claim 1, wherein the second contacts of the first conductive terminals are arranged separate from the second contacts of the second conductive terminals in two rows.

6. The electrical connector of claim 1, wherein the second contacts of the first conductive terminals and the second contacts of the second conductive terminals are alternatively arranged with each other.

7. The electrical connector of claim 1, wherein an insertion guiding part extends from the first face in a direction away from the second face, the guiding part including guiding recesses corresponding to the upper and lower insertion parts.

8. The electrical connector of claim 7, wherein the insertion guiding part prevents the improper mating of the mating connectors with the electrical connector assembly.

9. An electrical connector for mounting on a circuit board for providing an inserting connection with two mating connectors, comprising:

an insulative housing having a body formed thereto, two insertion parts respectively located on an upper half and a lower half of the body;

the body having a first face and a second face opposite to the first face, the insertion parts extending from the first face in a direction away from the second face;

wherein the insertion part on the lower half of the body include a first set of conductive terminals and the insertion part on the upper half includes a second set of conductive terminals, each of the first set of conductive terminals and the second set of conductive terminals having a first contact and a second contact, the first contacts extending from the first face of the body in a direction away from the second face and the second contacts protrude from the second face in a direction away from the first face;

wherein the second contacts of the first set off conductive terminals are alternatively arranged with the second contacts of the second set off conductive terminals in a single row.

10. The electrical connector of claim 9, wherein the second contacts of the second conductive terminals are divided into two groups, and the second contacts of the first conductive terminals are arranged between the two groups of the second contacts of the second set of conductive terminals.

11. The electrical connector of claim 9, wherein the second contacts of the first conductive terminals are arranged separate from the second contacts of the second conductive terminals in two rows.

12. The electrical connector of claim 9, wherein the second contacts of the first conductive terminals and the second contacts of the second conductive terminals are alternatively arranged with each other.

* * * * *